US011982151B2

(12) United States Patent
Schnell

(10) Patent No.: US 11,982,151 B2
(45) Date of Patent: May 14, 2024

(54) WELLBORE SLIP ASSEMBLY

(71) Applicant: 1487849 Alberta Ltd., Heritage Pointe (CA)

(72) Inventor: Rodney Schnell, Heritage Point (CA)

(73) Assignee: 1487849 Alberta Ltd., Heritage Pointe (CA)

( * ) Notice: Subject to any disclaimer, the term of this patent is extended or adjusted under 35 U.S.C. 154(b) by 0 days.

(21) Appl. No.: 17/918,545

(22) PCT Filed: Apr. 15, 2021

(86) PCT No.: PCT/CA2021/050504
§ 371 (c)(1),
(2) Date: Oct. 12, 2022

(87) PCT Pub. No.: WO2021/207840
PCT Pub. Date: Oct. 21, 2021

(65) Prior Publication Data

US 2023/0075955 A1 Mar. 9, 2023

Related U.S. Application Data

(60) Provisional application No. 63/010,847, filed on Apr. 16, 2020.

(51) Int. Cl.
*E21B 33/129* (2006.01)
*E21B 33/134* (2006.01)

(52) U.S. Cl.
CPC ..... *E21B 33/129* (2013.01); *E21B 33/134* (2013.01)

(58) Field of Classification Search
CPC ..... E21B 33/129; E21B 33/134
See application file for complete search history.

(56) References Cited

U.S. PATENT DOCUMENTS

| | | | | |
|---|---|---|---|---|
| 9,157,288 | B2 | 10/2015 | Martinez | |
| 9,759,029 | B2 | 9/2017 | Davies et al. | |
| 10,605,044 | B2 | 3/2020 | Davies et al. | |
| 2018/0016864 | A1* | 1/2018 | Parekh | E21B 33/1291 |

FOREIGN PATENT DOCUMENTS

| | | | | |
|---|---|---|---|---|
| CN | 201367871 | Y | 12/2009 | |
| CN | 106639994 | A | 5/2017 | |
| GB | 2384256 | A * | 7/2003 | E21B 23/01 |

* cited by examiner

*Primary Examiner* — Dany E Akakpo
(74) *Attorney, Agent, or Firm* — Gallium Law; Wesley Schwie

(57) ABSTRACT

A wellbore slip assembly includes a core and a helical slip. The core has an upper end, a lower end, an outer diameter tapering towards the lower end and a ratchet thread on the outer diameter. The helical slip has a base end, a top end, a substantially cylindrical outer surface, a bore with an inner diameter that tapers from the top end toward the base end, a ratcheted surface in the bore and a spiral cut extending from the top end between the outer surface and the bore. A method for installing a slip assembly in a structure includes running the slip assembly into place, and setting the slip assembly by holding the helical slip against axial movement and wedging a core of the slip assembly into a bore of the helical slip to radially enlarge the core and close the spiral cut.

12 Claims, 12 Drawing Sheets

WELLBORE SLIP ASSEMBLY

FIELD

The invention relates generally to a wellbore apparatus and, in particular, a wellbore slip assembly.

BACKGROUND

A wellbore slip assembly is an installation mechanism for installing a wellbore structure in the well. A wellbore slip assembly is run into place in a well and installed by setting the outer slip surfaces against a wellbore wall, which may be casing or open hole. The setting process is generally by expansion radially outwardly of the slips from a smaller diameter to a diameter that bears against the wellbore wall.

Wellbore slip assemblies are included on all kinds of downhole tools that are intended to be installed in a wellbore. Such tools include, for example, plugs, bridges, packers, whipstocks, patches, liner hangers, etc.

The wellbore slip assembly is sometimes large and complex, which increases running costs. If it must be removed from the well, there are considerations regarding the time and equipment that is needed for the removal.

There is a need for a small size wellbore slip assembly. There is considerable advantage if the slip assembly facilitates removal.

SUMMARY

A wellbore slip assembly has been invented. The wellbore slip assembly comprises of a core and a helical slip.

In accordance with a broad aspect of the invention, there is provided a wellbore slip assembly comprising: a core including an upper end, a lower end, an outer diameter tapering towards the lower end and a first lock on the outer diameter; and a helical slip including a base end, a top end, a substantially cylindrical outer surface, a bore with an inner diameter that tapers from the top end toward the base end, a second lock in the bore, the second lock configured to lock with the first lock and a spiral cut extending from the top end between the outer surface and the bore, the helical slip being configured to radially enlarge along the spiral cut by the core being forced into the bore.

In accordance with another broad aspect of the invention, there is provided a method for installing a slip assembly in a structure, comprising: running the slip assembly into place in the structure; and setting the slip assembly, including holding a helical slip of the slip assembly against axial movement; and wedging a core of the slip assembly into a bore of the helical slip, to apply a force that acts to radially enlarge the helical slip, thereby engaging an outer surface of the helical slip with a wall of the structure.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

The present disclosure is best understood from the following detailed description when read with the accompanied figures. The drawings are not necessarily drawn to scale.

DETAILED DESCRIPTION OF EMBODIMENTS

Figure 1:
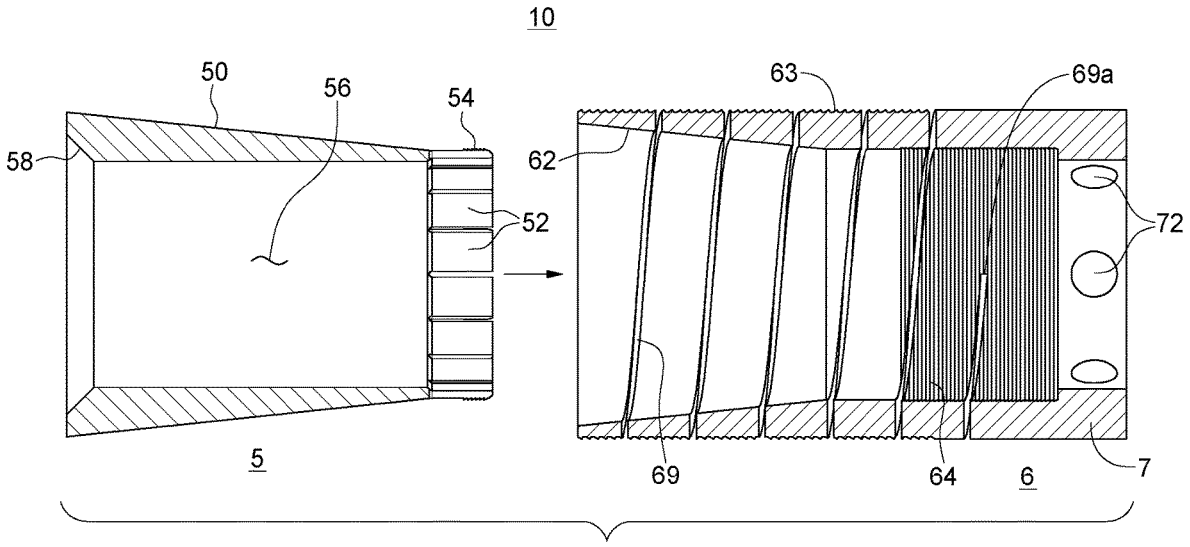
FIG. 1 is an exploded sectional view of a wellbore slip assembly according to the present invention, herein configured with a plug seat to be operable as a plug.
Figure 2:
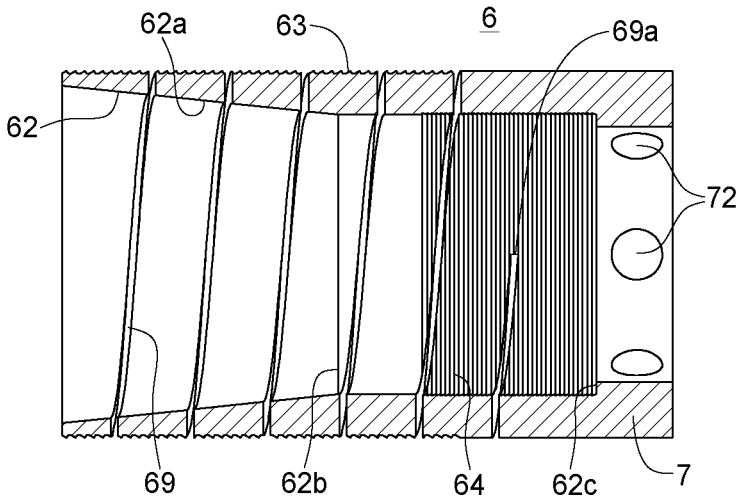
FIG. 2 is an axial sectional view of the helical slip of FIG. 1.

A slip assembly comprises a core and a helical slip, which is expanding helical slip with an outer surface configured to engage against a wellbore wall, cased or open hole, and has a spiral cut extending from its upper end toward its lower end.

Various embodiments of the wellbore slip assembly are illustrated and described. While the embodiments herein illustrate the wellbore slip assembly as part of a wellbore plug, it is to be understood that the wellbore slip assembly may be installed on other tools such as whipstocks, bridges, patches, etc. In these other tool configurations, the core is coupled to such as connected to or integral with the tool body.

With reference to FIGS. 1 to 7, a wellbore slip assembly 10 comprises a core 5 and a helical slip 6, which is a helical body that acts as an expandable helical slip.

Briefly in operation, the core 5 acts to expand the helical slip out into engagement with a wellbore wall. Core 5 is employed like a wedge and is forced, narrow end first, into the wider end of the inner open diameter of the helical slip 6. Because of (i) cooperating frustoconical surfaces on the outer surface of the core and within the inner diameter of the slip and (ii) the helical shape of the slip 6, this wedging action by the core forces the helical slip to expand radially out into engagement with the wellbore wall. To prevent the core from backing out of the helical slip, a lock such as interacting ratcheted surfaces can be provided on each of core 5 and within the inner diameter of the helical slip.

As such, core 5 comprises a radially outwardly facing surface that has an outer surface portion 50 shaped frustoconically, which configures the core to act as a wedge. Core 5 also includes locking mechanism such as a ratcheted surface 54 on its outer-facing surface. In the illustrated embodiments of FIGS. 1-7, frustoconical outer surface 50 is generally smooth and ratcheted surface 54 is positioned at a leading, narrower end of the core.

The outer surface 50 is tapered, such that the core decreases in outer diameter from the upper end towards the lower end of the core. Thus, the outer diameter of the core is smaller across the lower end than across the upper end and is generally frustoconical. As noted the outer surface portion 50 is generally smooth, for example, without ratchet teeth.

Ratcheted surface 54 of the core has a ratchet thread form that allows axial downward movement of the core as against a ratchet interface but does not allow reverse upward movement. To facilitate movement of the ratchet teeth over the ratchet interface, ratcheted surface 54 is positioned on cylindrical arrangement of resilient collet tabs 52. Tabs 52, each being separated from adjacent tabs by a small gap, can be resiliently deformed radially inwardly toward the center axis of the core bore 56 but pop back out and bias the ratchet teeth of ratcheted surface 54 into engagement with the ratchet interface 64 of the helical slip 6. While the outer diameter of the core tapers along outer surface, tabs 52 of collet do not taper, but instead have a substantially consistent diameter along their length with ratchet teeth protruding therefrom.

Apart from the frustoconical form and the locking mechanism, the core can take various forms. For example, the core may be solid. However, as noted above slip assembly illustrated in FIGS. 1-7 is configured as a plug and core 5 includes a through bore 56 extending along its long axis from the core's upper end to its lower end. This bore creates a fluid passage though the core. The core further includes a plugging mechanism built into the core's open inner diameter. In FIG. 1, the core's plugging mechanism includes a ball seat 58 in the bore 56. The seat 58 is adapted to receive a conveyed plugging device such as a ball or dart. The seat, for example, can be an annular chamfered area at an upper end of the bore or a shoulder or other constriction in the core inner diameter that faces up toward the upper end.

Figure 3:
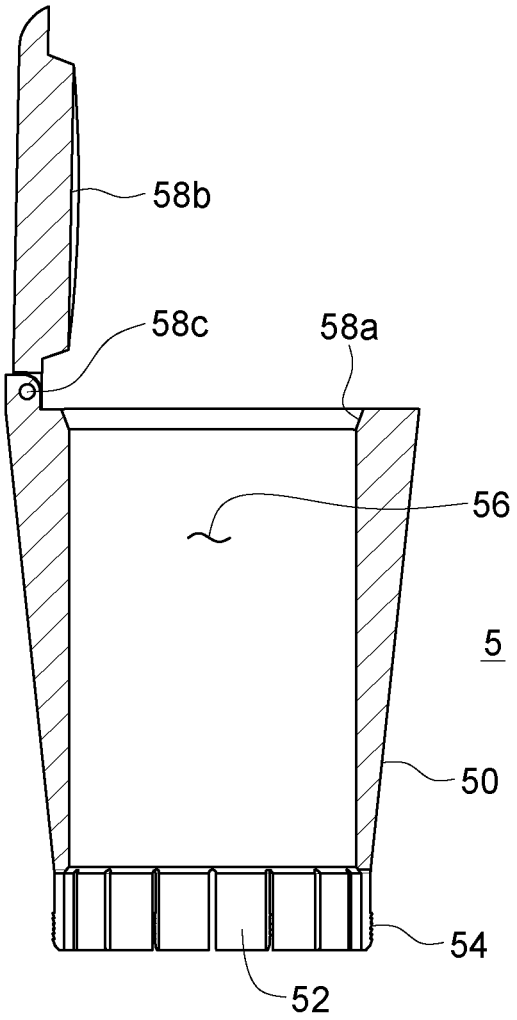
FIG. 3 is an axial sectional view of another core useful in the wellbore slip assembly of FIG. 1.
Figure 4:
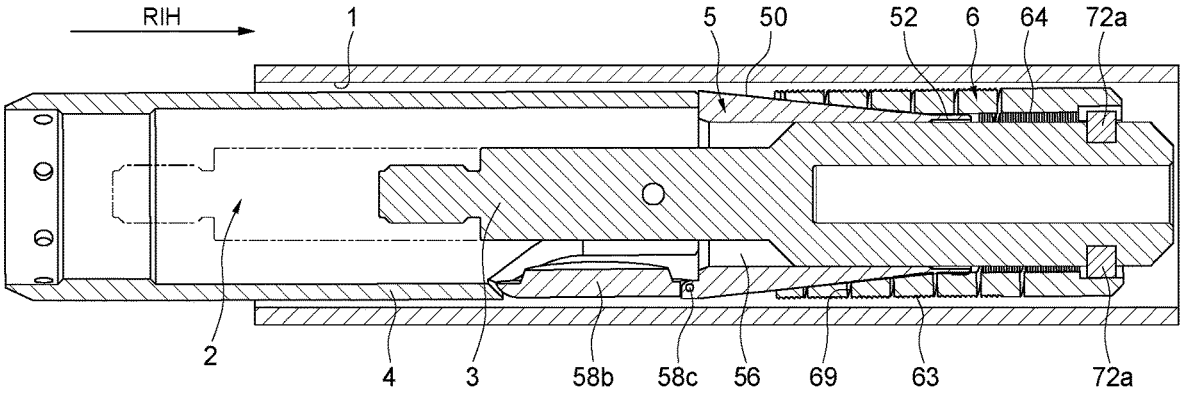
FIG. 4 shows the entire cross-sectional view of the wellbore slip assembly in the run in hole (RIH) configuration on an optional running/setting tool.

Alternatively, depending on need, such as in FIG. 3, core 5 can be fitted with a flapper float, such as including an annular seating area 58*a* and a flapper seal 58*b* connected to the core body by a pivotal connection 58*c*. The flapper is illustrated in a run in position, open, but the flapper seal can pivot down against the seating area 58*a* when holding pressure from above. To facilitate inventory, the core of FIG. 3 could be used to accept a ball or dart, simply by removing the flapper seal 58*b* from the core body. Then a conveyed sealing device could be landed directly on seating area 58*a*.

Alternatively, another sealing mechanism, such as for example, a captured poppet valve could be employed to seal bore 56 of core 5 in both directions upward and downwardly through the bore 56.

Helical slip 6, also sometimes called an expanding load ring herein, has an annular body with an inner bore 62. The bore extends from the upper end of helical slip 6 toward its lower end. In this illustrated embodiment, bore 62 extends all the way through the helical slip from its upper end to its lower end along the long axis of the body. In the assembly, the helical slip surrounds core 5 and is the structure that engages wellbore wall 1. Specifically, the core is positioned in bore 62 of the helical slip and, in use, the core is driven deeper into the bore 62 to radially expand the helical slip. Once the core is driven to expand the helical slip 6 sufficiently to set the slip assembly in the wellbore, the core can be locked in the helical slip to ensure it remains in the expanded, set condition. For example, the core can be locked in the helical slip by the core's ratcheted area 54 on the outer surface of the core interfacing with a ratcheted form 64 on the surface within the bore 62 of the helical slip.

To permit core to be driven into the helical slip 6, the bore 62 includes a tapered portion 62*a* that has a tapering, frustoconical, substantially smooth inner diameter that tapers toward the bottom end of the slip. The tapering angle along the tapering portion of bore 62 is about the same as the tapering angle along outer surface 50. The maximum outer diameter across the upper end of the core, however, is greater than the maximum inner diameter across bore 62. Bore 62 also includes a deeper area, below the bottom end 62*b* of the tapering portion, where the inner diameter transitions to a substantially non-tapering, cylindrical portion. An end wall, inwardly projecting ledge 62*c*, defines the maximum depth of the substantially non-tapering, cylindrical portion. The substantially non-tapering, cylindrical portion has a side-to-side inner diameter dimension about the same as the outer diameter across the core tabs 52. The non-tapering area has an axial length longer than the length of tabs 52.

The inner surface of the non-tapering area has ratchet teeth 64 exposed thereon that are selected to lock with the teeth of ratcheted area 54 on core 5. Ratcheted area 54 and ratchet teeth 64 are configured to create a locking ratchet interface that permits core 5 to move deeper into the bore of helical slip 6, but core 5 cannot be pulled out. In other words, the ratchet teeth 54 on the core outer surface ensures that the core can move axially further down into the bore of the helical slip but cannot reverse back out of the helical slip bore. Thus, the inner bore 62 of the helical slip is shaped and configured to receive and lock the core and also shaped to receive an expansive force from the advancement of the core therein.

The annular body of helical slip 6 is a helical structure. In particular, the bore is formed as the center of a helical coil. To create the helical structure, in the illustrated embodiment, the helical slip's annular body has an angled cut, termed a spiral cut 69, which configures the annular body as a form of coil spring. The spiral cut permits the helical slip to radially enlarge, when a force is applied by the core being pushed, for example, wedged, deeper into the bore. The spiral cut extends fully through the radial thickness of the body and extends from the upper end towards the lower end of the body. The helical slip must be capable of radial enlargement, in the same mode as radial enlargement of a coil spring without failure. The spiral cut in the embodiment of FIGS. 1 to 7 terminates at 69*a* near the bottom of the helical slip and, therefore, does not extend fully to the lower end of the helical slip annular body. Being spirally cut, cut 69 does not extend directly axially from top to bottom, but the bottom terminal point 69*a* of the cut is offset rotationally from the top initial point of that cut on upper end. The angle and length of the spiral cut from the bottom point 69*a* to the top initial point is at least sufficient that when the helical slip is fully radially enlarged and biting into the wellbore wall, the cut surfaces remain overlapping axially. In one embodiment, for example, the radial, spiral cut 69 in the helical slip extends more than one, for example about two or more, full rotations of the helical slip circumferential body. The spiral cut 69 extends down below point 62*b*, and terminal point 69*a* is in the substantially non-tapering, cylindrical portion of bore 62. In one embodiment, terminal point 69*a* is spaced from end wall 62*c* a distance that permits ratchet teeth 54 on core to reside in non-expanding region of the bore. In particular, the distance between terminal point 69*a* and end wall 62*c* may be at least as long as the length of collet tabs 52 on which ratchet teeth 54 are located.

The outer surface of the helical slip has wickers 63 defined thereon. Wickers 63 are teeth with sharped outer tips for engaging the wellbore wall 1, for example of casing. The outer surface of helical slip 6 is generally cylindrical, substantially without a taper, which means that the outer surface outer diameter is substantially consistent from upper end to lower end. While the run in position of the helical slip has an outer diameter less than the inner diameter across the wellbore, the helical slip when radially expanded, by wedging the core 5 therein, can engage against and grip the wellbore wall, thereby setting the slip assembly. The slip assembly, therefore, is formed by the co-acting core and helical slip being wedged together and locked at their ratcheting surfaces 54, 64. The upper angled portion 50 of the core, which has a maximum outer diameter greater than the maximum inner diameter of bore 62, forces the upper end of the helical slip to radially enlarge when the core is fully wedged therein.

A metal-to-metal seal is created between the wellbore wall and the helical slip, as the wickers bite into the wall 1. The outer diameter of the helical slip has a large number of wickers, with a shallow depth. This shallow depth allows for full depth penetration into casing which will enhance the metal-to-metal seal. A metal-to-metal seal is also created along the spiral cut 69 as the helical turns are compressed together and any gap at the spiral cut closes. If leaks occur through the interface or along the spiral cut, a deformable seal 67 may be added to the lock ring. The deformable seal may be a continuous annular body for example on the upper end of the helical slip, which follows the circumference of the helical slip.

A setting tool 2 is used to set the slip assembly, which means the setting tool facilitates the axial advancement of core 5 into bore 62 of the helical slip to radially enlarge it. The setting tool can include various structures that hold the helical slip while the core is pushed into its bore. In one embodiment, for example, the setting device may include one or more shear pins 72*a* between a mandrel 3 of the setting tool and helical slip 6. In particular, in the illustrated embodiment, the lower end of the helical body is formed as a setting device mount area 7 with shear pin mounting apertures 72, which retain pins 72*a*.

The wellbore slip assembly parts, such as the core and helical slip, can be made of typical materials that are durable and substantially permanent in wellbore conditions, such as steel, for example mild steel or stainless steel. As noted, however, removal of the wellbore slip assembly may be of interest. Surprisingly, it has been determined that a degradable material such as a degradable metal material, for example, an aluminum/magnesium degradable material, such as a 25-45 ksi material, is strong enough to bite into the wellbore wall, and engage with the core, and also is readily enlarged without failure. At the same time, the material degrades in a reasonable period in wellbore conditions. The core and shear pins may also be constructed of a degradable material such as a degradable metal material, for example, an aluminum/magnesium degradable material, such as a 25-45 ksi material. Even the rubber elements can be formed of a material selected to degrade at wellbore conditions. These materials can degrade in a period of a day to a few months, depending on preferences.

Figure 5:
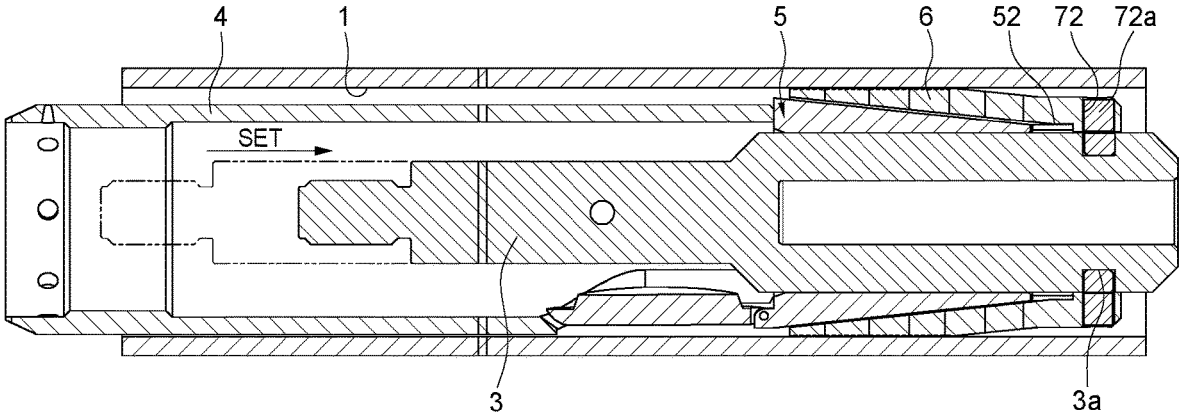
FIG. 5 illustrates the core and the spiral ratchet helical slip being compressed and set in the wellbore casing.
Figure 6:
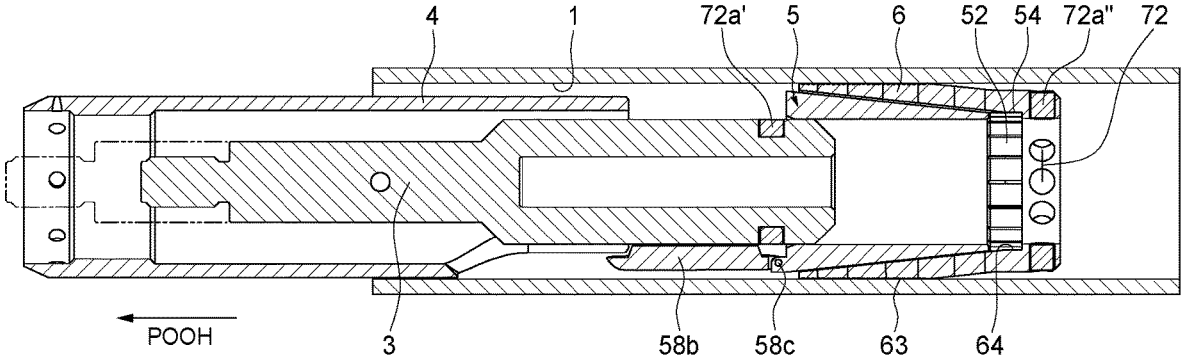
FIG. 6 illustrates the setting tools sheared out, released and being pulled out of the hole (POOH)
Figure 7:
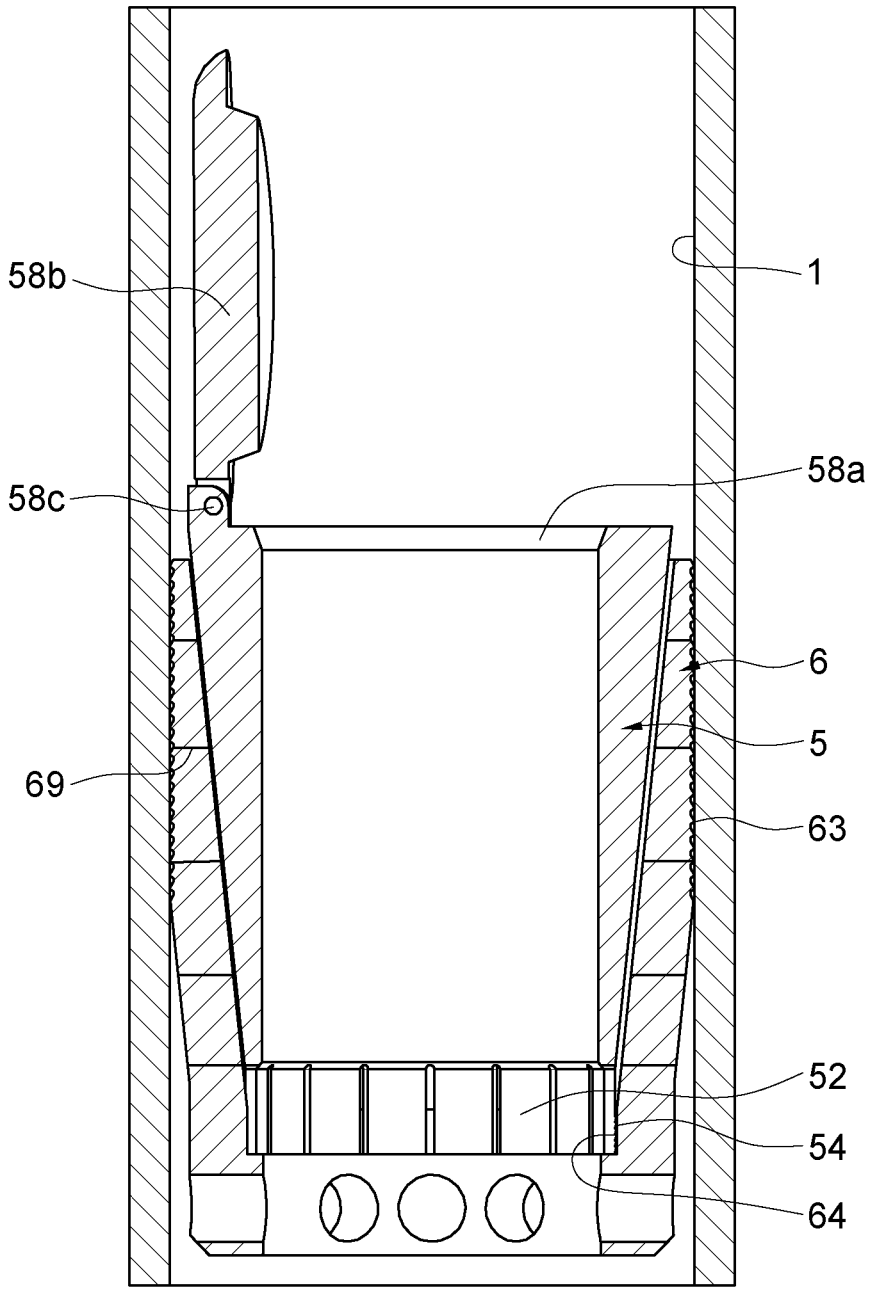
FIG. 7 is an axial sectional view of the wellbore slip assembly set in the hole.

In operation, the wellbore slip assembly is run into a well along direction RIH (FIG. 4), is actuated to expand and be set in the wellbore against wellbore wall 1 (FIG. 5) and is left in the well (FIGS. 6 and 7).

In the run in position (FIG. 4), core 5 is loosely assembled with the helical slip. For example, the narrow lower end of core may be loosely residing in or locked in, but not fully inserted into, the bore of the helical slip 6. In the illustrated embodiment, tabs 52 are close to or just inserted into the cylindrical bore portion of the helical slip bore. The ratcheted area 54 may be close but axially spaced from or engaged with the ratchet teeth 64. As such, the frustoconical outer diameter 50 is positioned close to the tapering inner diameter 62 of helical slip 6. However, core 5 is substantially not applying an expansive force to the helical slip. As a result, helical slip 6 is in the neutral, non-expanded position, so it has clearance to move through the well.

Run in can be by any one of various means, such as by a connected running tool or string, herein an extension of setting tool 2, and/or by a pump down assembly. Setting can be by setting tool 2 that holds directly or indirectly the helical slip and actuates the core and helical slip so that the core is forced into the bore of the helical slip. Generally, helical slip 6 is held against axial movement, while forcing the core down into the bore of the helical slip. In the illustrated embodiment, setting tool 2 includes a mandrel 3 coupled to helical slip and a setting sleeve 4 concentric about, and axially moveable relative to, the mandrel. Setting sleeve 4 is configured to apply a downward force, see arrow SET, against core 5, while mandrel 3 holds helical slip 6 axially stationary (FIG. 5). When the core is forced into the bore of the helical slip, as soon as the core's frustoconical surface 50 reaches the point 62*b*, further advancement of the core causes the helical slip to initiate radial expansion. As surface 50 is wedged down against the tapered surface 62*a* of the helical slip, any gap at the spiral cut 69 is closed and the helical turns of the annular body, acting like a coil spring, slide against each other along spiral cut 69 to cause radial enlargement. As a result, helical slip 6 increases in diameter until the wickers 64 bite into the wellbore wall 1.

Advancement of the core 5 into the helical slip is stopped either when it is sensed, for example by back pressure, that the helical slip is sufficiently expanded or the core tabs 52 are stopped against the end wall 62*c*.

When the wellbore slip assembly is set in the wellbore (FIG. 6), the running and setting tools can be removed if they interfere with the operation of the plug. In the illustrated embodiment, for example, the shear pins 72*a* are sheared to release the coupling between helical slip 6 and gland 3*a* of the setting tool mandrel 3. Of course, the shear pins are selected to hold the setting force, but can be sheared out after the helical slip is set against the wellbore wall. The shear pins, therefore, are selected to allow even wicker set depth into casing. After shearing, the running and setting tools can be pulled out of the hole (POOH), as shown by arrow POOH.

After the slip assembly is set and, if necessary, the running and setting tools are removed, the wellbore slip assembly holds the tool in the well. In this illustrated embodiment, where the wellbore slip assembly is part of a wellbore plug, the after setting, the plug is ready for operation to create a seal in the well (FIG. 7). In the illustrated embodiment, for example, the flapper 58*b* will pivot about hinge and seal against the upper end of the core, specifically at the seat 58*a* defined therein. During operation, pressures above the tool that create a pressure differential across the plug, drive the core down into the helical slip, thereby increasing the metal-to-metal seal and the wicker holding force.

Over time, the wellbore slip assembly including helical slip 6, core 5 and shear pins 72*a* will degrade at well bore conditions so that the wellbore becomes opened again.

The wellbore slip assembly has a large window of radial expansion. For example, a helical slip with a 3" OD run in size can be expanded to set in 4½" casing which is a significantly larger expansion capability than standard tool slips. Also, the wellbore slip assembly is useful for setting in multiple casing weights. Because of the full circumferential and substantially uniform load, the wellbore slip assembly is appropriate for use in a large variety of casing weights with a single slip design. This is very unique.

It will be appreciated that various modifications can be made to the invention. While the embodiment, of FIGS. 1 to 7 has been found to operate very well, another slip assembly is shown in FIGS. 8 to 11 only to show that modifications are possible. This embodiment includes a core 5 and a helical slip 6 and the operation of the slip assembly is effectively the same as that in FIGS. 1 to 7. While the wellbore slip assembly is also configured as a plug, it is to be understood that the wellbore slip assembly remains useful for installation of other wellbore tools as well.

The description of the FIGS. 8 to 11 will focus on differences in comparison to the embodiment of FIGS. 1 to 7.

The core 5 comprises ratchet teeth on a major portion of outer diameter surface, including on the frustoconical surface. The embodiment, includes a plug seat 58*a* built into the core's open inner diameter and FIG. 8 illustrates how a ball 58*d* can be landed on the seat to create a seal in the wellbore, defined by wall 1.

The core outer surface has a higher taper angle on the upper end 54*a* than the lower end 54*b*. As such, the core outer surface has two different tapering angles, where the upper portion 54*a* flares out at a greater angle beyond the lower portion 54*b* starting at a transition circumference 55. Thus, there is one taper angle β from the uppermost end to the transition circumference and more gradual tapering angle α from the transition circumference to the lowermost end. These two tapering angles may assist in loading of the ratchet expanding helical slip. The difference between the upper and lower tapering angles may be small, such as 1-10 or possibly 1-5°.

The spiral ratchet expanding helical slip 6 is generally as described above in respect of FIGS. 1 to 7. The bore 62 of the helical slip is, as noted above, tapered from the top to bottom. The taper angle substantially matches the angle on the lower portion 54*b* of the core. A major portion of bore 62 has ratchet teeth 64.

Figure 8:
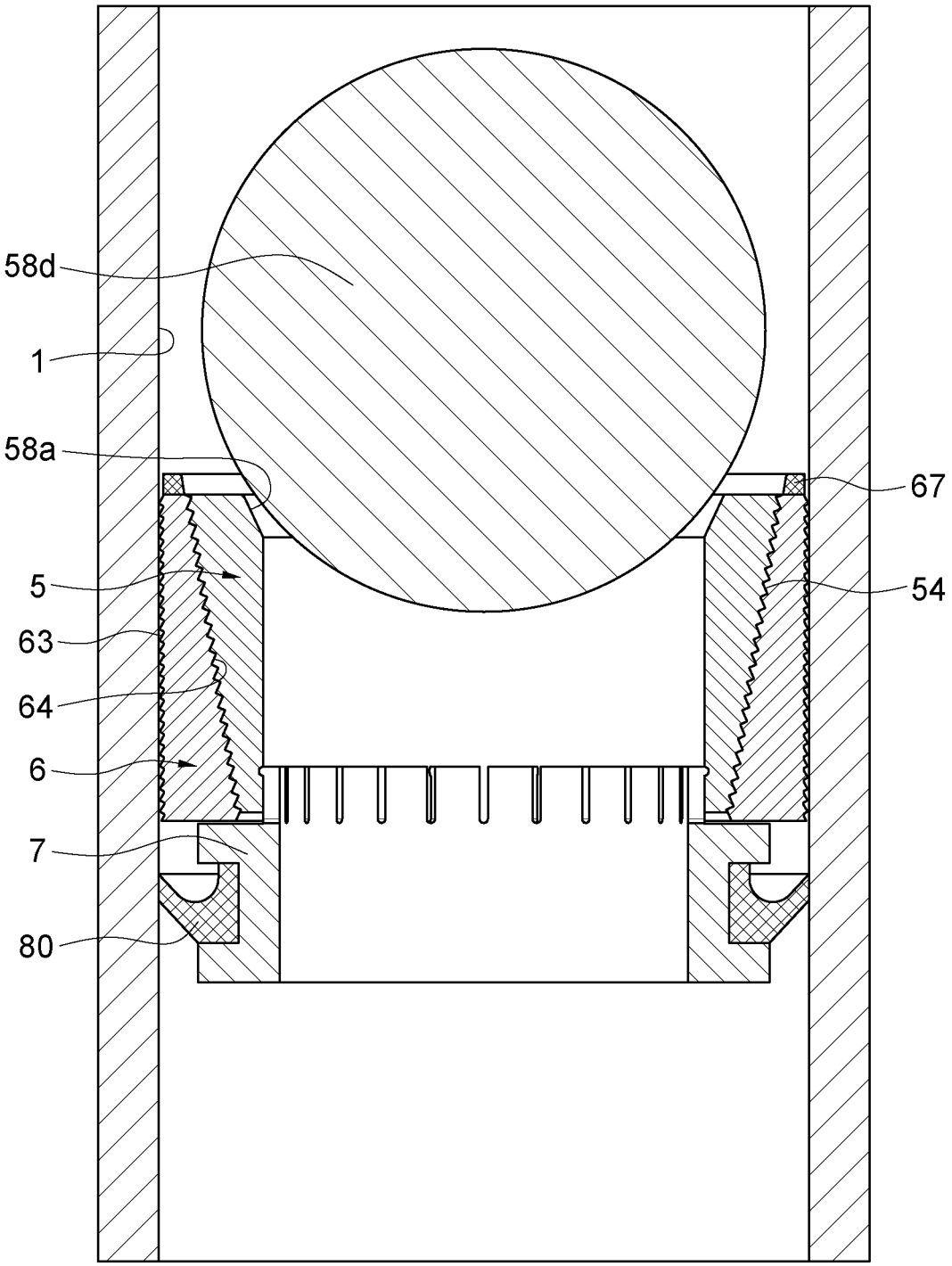
FIG. 8 illustrates schematically a vertical axial section of another wellbore slip assembly, configured as a plug, as it is set in the wellbore with a ball on the ball seat ready for hold pressure such as in a stimulation operation.
Figure 8A:
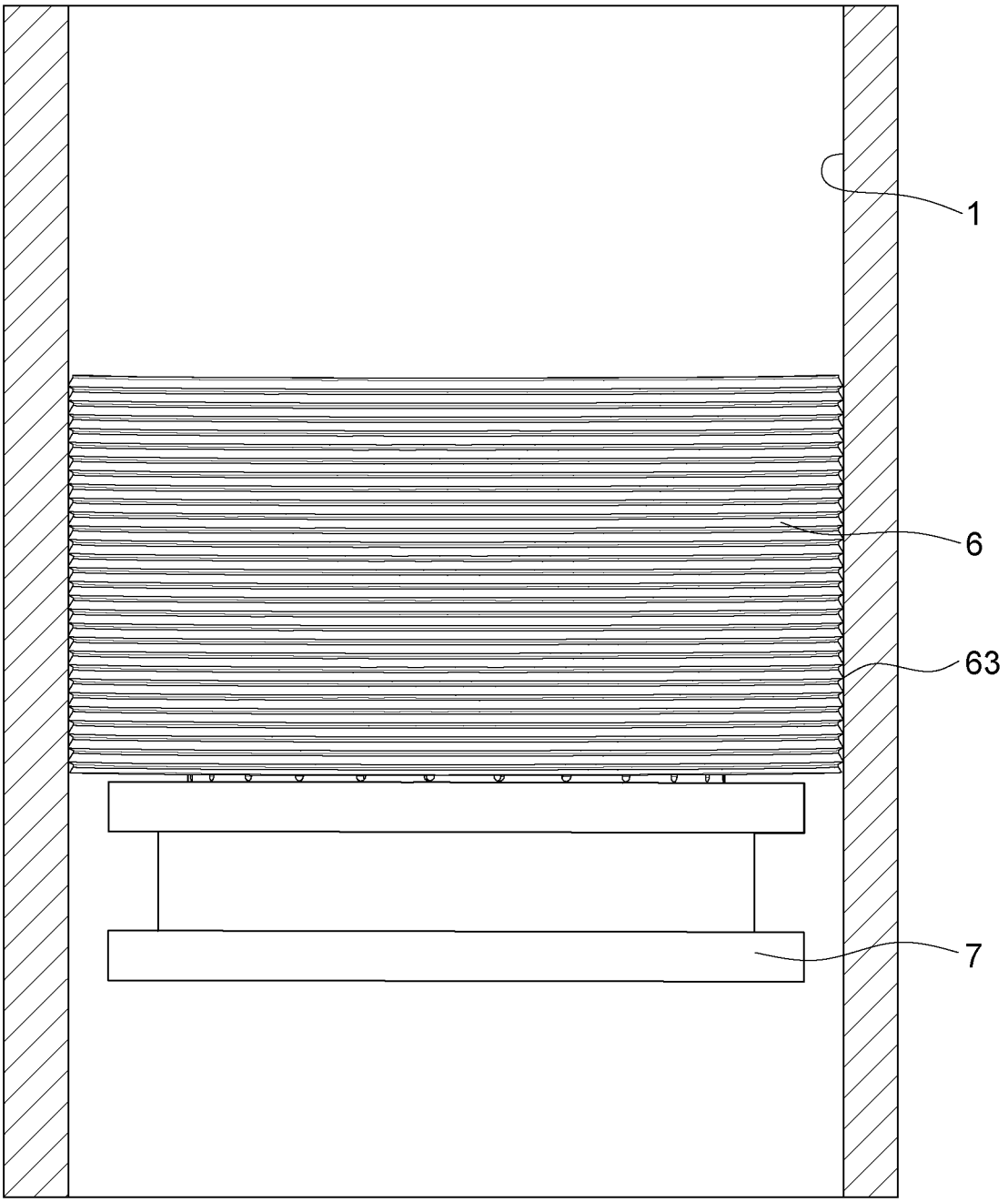
FIG. 8*a* illustrates schematically the outer surface of the wellbore slip assembly of FIG. 8 without the ball and the wiper fin.
Figure 9:
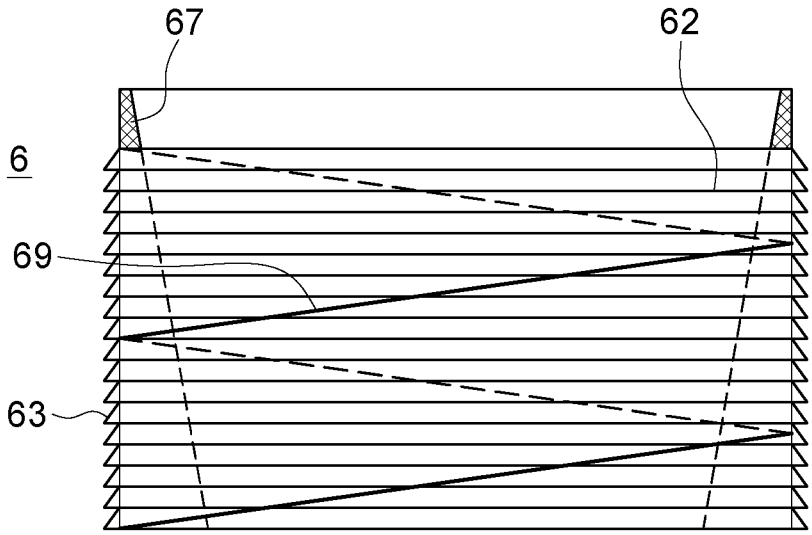
FIG. 9 is a schematic side elevation of a helical slip useful in the wellbore slip assembly of FIG. 8.
Figure 10:
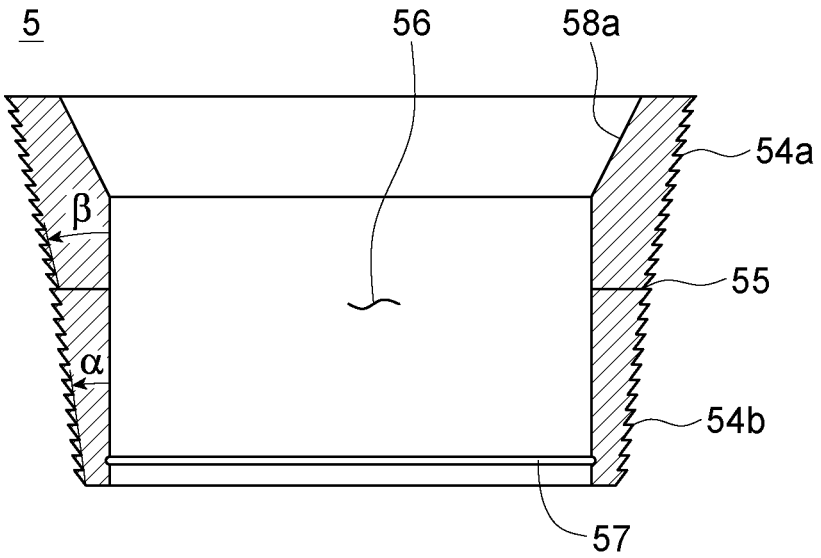
FIG. 10 is a schematic axial sectional view of a core useful in the wellbore slip assembly of FIG. 8.
Figure 11:
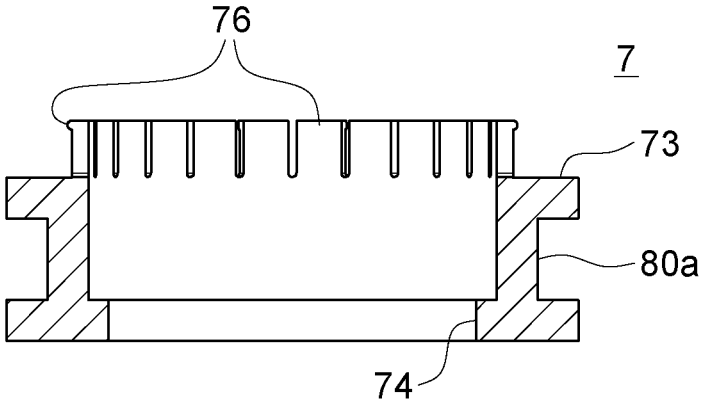
FIG. 11 is a schematic axial sectional view of a setting nut useful in the wellbore slip assembly of FIG. 8.

The spiral cut 69 of the helical slip in the embodiment of FIGS. 8 to 10 extends fully from the upper end to the lower end of the annular body.

Helical slip has a deformable seal 67 encircling its upper end. Seal 67 mitigates leaks along the wicker 63 to wall 1 interface and/or along the spiral cut 69. The deformable seal may be a continuous annular body to follow the circumference of the helical slip. If the wellbore slip assembly is selected to disintegrate at wellbore conditions, the resilient material of the seal may also be selected to break down at wellbore conditions.

While the helical slip in FIGS. 1 to 7 was coupled to a setting tool by one or more shear pins, in this embodiment, a separate setting ring 7 is employed here. Setting ring 7 is coupled to the setting tool mandrel via a shearable connection such as a ring connection 74. The setting ring includes an upper-facing shoulder 73 that holds the helical slip 6 stationary during the setting process, to thereby react the downward axial forces of the core being forced into the helical slip bore. The shoulder 73 has a diameter greater than both the run in and the expanded inner diameter of the helical slip. The helical slip, however, is free to radially enlarge, relative to the setting ring. In one embodiment, the helical slip and setting ring are free of any connection between them that restricts the radial enlargement of the helical slip relative to the setting ring. The setting ring can be configured in various ways depending on various selections. There may be a coupling member such as locking collet 76 on the setting ring that latches into a groove 57 on the core or onto the helical slip after the setting process or when the running tool is detached.

Setting ring 7 also provides a useful site for a pump down assembly such as an annular wiper fin 80, which can be installed in gland 80*a*.

In use, the wellbore slip assembly is run in by a running tool and/or via pump down pressure against wiper fin 80.

The wellbore slip assembly is set in the wellbore by forcing core 5 down into the bore of the helical slip to radially expand it. The upper angle of the core, which has a greater taper angle, forces the upper end of the helical slip to radially enlarge ahead of the lower end of the helical slip. Thus, the wickers on the upper end of the helical slip are driven out first by the larger diameter upper end of the core and to set into the casing first. Therefore, the flaring upper end of the core may preload the helical slip, wherein the upper end of the helical slip are very quickly driven into engagement with the wellbore wall. Full load support is achieved even within the first half of the setting process.

The setting tool can be removed by shearing the ring connection 74. The setting ring may fall away from the assembly of core 5 and helical slip 6 or the setting ring may include the locking collet 76 that keeps it coupled on the bottom of the plug.

After the slip assembly is set and, if necessary, the running and setting tools are removed, the wellbore plug is ready for operation to create a seal in the well (FIG. 8). In the illustrated embodiment, for example, ball 58*d* is landed in upper end of the core, specifically at the seat defined therein. The setting ring serves no purpose, but it can remain attached at the bottom of the plug. The wiper fin, if present, may also remain attached. During operation, pressures above the tool that create a pressure differential across the plug, drive the core down into the helical slip, thereby increasing the metal to metal seal between the core and the helical slip and between wickers 63 and wall 1 and the wicker holding force.

Over time, the plug including the lock ring, core, shear ring, ball, seal 67 and wiper fin 80 will degrade at well bore conditions so that the wellbore becomes opened again.

One or more of the optional differences described with respect to FIGS. 8 to 11 can be used in combination with the features of the preferred embodiment of FIGS. 1 to 7.

CLAUSES

Clause 1. A wellbore slip assembly comprising: a core including an upper end, a lower end, an outer diameter tapering towards the lower end and a ratchet thread on the outer diameter; and a helical slip including a base end, a top end, a substantially cylindrical outer surface, a bore with an inner diameter that tapers from the top end toward the base end, a ratcheted surface in the bore and a spiral cut extending from the top end between the outer surface and the bore, the helical slip being configured to radially enlarge along the spiral cut by the core being forced into the bore.

Clause 2. The wellbore slip assembly of any one or more of clauses 1-14, wherein the core outer diameter includes a frustoconical, smooth outer surface on the upper end and the ratchet thread is on the lower end and wherein the bore of the helical slip includes a tapered, smooth portion at the top end and a deeper portion closer to the bottom end, the deeper portion being substantially non-tapering and wherein the ratcheted surface is in the deeper portion.

Clause 3. The wellbore slip assembly of any one or more of clauses 1-14, wherein the core includes a collet on its lower end and the ratchet thread is on collet.

Clause 4. The wellbore slip assembly of any one or more of clauses 1-14, wherein the deeper portion has a side to side inner diameter dimension about the same as an outer diameter dimension across the collet and the deeper portion has an axial length longer than a length of the collet.

Clause 5. The wellbore slip assembly of any one or more of clauses 1-14 wherein the spiral cut terminates in the deeper portion.

Clause 6. The wellbore slip assembly of any one or more of clauses 1-14, wherein the core includes a through bore extending along its long axis from the upper end to the lower end and a plugging mechanism in the through bore, thereby configuring the wellbore slip assembly as a wellbore plug.

Clause 7. The wellbore slip assembly of any one or more of clauses 1-14, wherein the core and the helical slip are each constructed of a degradable material.

Clause 8. The wellbore slip assembly of any one or more of clauses 1-14, further comprising: a coupling mechanism to couple the helical slip to a setting tool.

Clause 9. A method for installing a slip assembly in a structure, comprising: running the slip assembly into place in the structure; and setting the slip assembly, including holding a helical slip of the slip assembly against axial movement; and wedging a core of the slip assembly into a bore of the helical slip, to apply a first force that acts to radially enlarge the helical slip, thereby engaging a ratcheted outer surface of the helical slip with a wall of the structure; and a second force that acts to axially compress the helical slip to close a spiral cut of the helical slip.

Clause 10. The method of any one or more of clauses 1-14, further comprising: locking the core into the helical slip by engaging interacting ratcheted surfaces on each of the core and within an inner diameter of the helical slip.

Clause 11. The method of any one or more of clauses 1-14, further comprising: plugging the core by receiving a plugging device in a seat of the core.

Clause 12. The method of any one or more of clauses 1-14, wherein: holding the helical slip against axial movement includes coupling a setting tool to the helical slip via one or more shear pins; and wedging the core into the bore includes pressing the setting tool axially against the core and towards the bore.

Clause 13. The method of any one or more of clauses 1-14, further comprising removing the setting tool.

Clause 14. The method of any one or more of clauses 1-14, further comprising removing the slip assembly, including by permitting one or more materials of the slip assembly to degrade.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A wellbore slip assembly comprising:

a core including an upper end, a lower end, an outer diameter tapering towards the lower end and a first lock on the outer diameter; and a helical slip including a base end, a top end, a substantially cylindrical outer surface, a bore with an inner diameter that tapers from the top end toward the base end, a second lock in the bore configured to lock with the first lock and a spiral cut extending from the top end between the outer surface and the bore, the helical slip being configured to radially enlarge along the spiral cut by the core being forced into the bore; wherein the core outer diameter includes a frustoconical, smooth outer surface on the upper end and the first lock includes a ratchet thread on the lower end and wherein the bore of the helical slip includes a tapered, smooth portion at the top end and a deeper portion closer to the bottom end, the deeper portion being substantially non-tapering and wherein the second lock is a ratcheted surface is in the deeper portion.

2. The wellbore slip assembly of claim 1, wherein the core includes a collet on the lower end and the first lock is on the collet.

3. The wellbore slip assembly of claim 2, wherein the deeper portion has a side to side inner diameter dimension about the same as an outer diameter dimension across the collet and the deeper portion has an axial length longer than a length of the collet.

4. The wellbore slip assembly of claim 3 wherein the spiral cut terminates in the deeper portion.

5. The wellbore slip assembly of claim 1, wherein the core includes a through bore extending along its long axis from the upper end to the lower end and a plugging mechanism in the through bore, thereby configuring the wellbore slip assembly as a wellbore plug.

6. The wellbore slip assembly of claim 1, wherein the core and the helical slip are each constructed of a degradable material.

7. The wellbore slip assembly of claim 1, further comprising: a coupling mechanism to couple the helical slip to a setting tool.

8. A method for installing a slip assembly in a structure, comprising:

running the slip assembly into place in the structure;

setting the slip assembly, including:

holding a helical slip of the slip assembly against axial movement;

wedging a core of the slip assembly into a bore of the helical slip, to apply a force that acts to radially enlarge the helical slip; and engaging an outer surface of the helical slip with a wall of the structure; and locking the core into the helical slip, wherein locking is by engaging interacting ratcheted surfaces on each of the core and within an inner diameter of the helical slip.

9. The method of claim 8, further comprising: plugging the core by receiving a plugging device in a seat of the core.

10. The method of claim 8, wherein:

holding the helical slip against axial movement includes coupling a setting tool to the helical slip via one or more shear pins; and wedging the core into the bore includes pressing the setting tool axially against the core and towards the bore.

11. The method of claim 10, further comprising removing the setting tool.

12. The method of claim 8, further comprising removing the slip assembly, including by permitting one or more materials of the slip assembly to degrade.

* * * * *